US011045802B2

(12) United States Patent
Weber

(10) Patent No.: US 11,045,802 B2
(45) Date of Patent: Jun. 29, 2021

(54) SAMPLE CARRIER

(71) Applicant: THINXXS MICROTECHNOLOGY AG, Zweibrücken (DE)

(72) Inventor: Lutz Weber, Zweibrücken (DE)

(73) Assignee: THINXXS MICROTECHNOLOGY AG, Zweibrücken (DE)

( * ) Notice: Subject to any disclaimer, the term of this patent is extended or adjusted under 35 U.S.C. 154(b) by 143 days.

(21) Appl. No.: 15/738,421

(22) PCT Filed: May 11, 2016

(86) PCT No.: PCT/EP2016/060498
§ 371 (c)(1),
(2) Date: Dec. 20, 2017

(87) PCT Pub. No.: WO2016/206854
PCT Pub. Date: Dec. 29, 2016

(65) Prior Publication Data

US 2018/0185841 A1 Jul. 5, 2018

(30) Foreign Application Priority Data

Jun. 22, 2015 (EP) ..... 15173174

(51) Int. Cl.
*B01L 3/00* (2006.01)
*A61J 1/05* (2006.01)

(52) U.S. Cl.
CPC ..... *B01L 3/502715* (2013.01); *A61J 1/05* (2013.01); *B01L 3/502707* (2013.01);
(Continued)

(58) Field of Classification Search
CPC .. B01L 3/502; B01L 3/5027; B01L 3/502715; B01L 3/502707;
(Continued)

(56) References Cited

U.S. PATENT DOCUMENTS 5,257,984 A * 11/1993 Kelley ..... B01L 3/5021 422/918
5,833,630 A * 11/1998 Kloth ..... A61B 5/150022 604/509
(Continued)

FOREIGN PATENT DOCUMENTS

DE 9417612 U1 1/1995
EP 2821138 A1 1/2015
(Continued)

OTHER PUBLICATIONS

Chen et al. "Improving blood-compatibility of titanium by coating collagen-heparin multilayers" Applied Surface Science vol. 255, Issue 15, May 15, 2009, pp. 6894-6900 (Year: 2009).*

*Primary Examiner* — Samuel P Siefke
*Assistant Examiner* — Quocan B Vo
(74) *Attorney, Agent, or Firm* — Lucas & Mercanti, LLP; Klaus P. Stoffel

(57) ABSTRACT

A sample carrier having a region for receiving a sample which is to be analyzed, the volume thereof being between 1-100 μl, and having an area for handling the sample carrier. The sample carrier is characterized by devices for the fluid-tight placement of the sample carrier together with the sample in an analysis device. An analysis device, in particular a flow cell, includes the sample carrier.

16 Claims, 9 Drawing Sheets

(52) U.S. Cl.
CPC ..... *B01L 2200/027* (2013.01); *B01L 2200/16* (2013.01); *B01L 2300/046* (2013.01); *B01L 2300/069* (2013.01); *B01L 2300/0681* (2013.01); *B01L 2300/0816* (2013.01); *B01L 2300/161* (2013.01); *B01L 2400/0406* (2013.01)

(58) Field of Classification Search
CPC ..... B01L 2200/027; B01L 2200/16; B01L 2300/046; B01L 2300/0681; B01L 2300/069; B01L 2400/0406; B01L 2300/0816; B01L 2300/161; A61J 1/05; A61B 5/150343; A61B 5/151
See application file for complete search history.

(56) References Cited

U.S. PATENT DOCUMENTS 6,319,209 B1 * 11/2001 Khz ..... G01N 33/5302 600/583
9,121,057 B2 * 9/2015 Gohring ..... B01L 3/502715
2009/0291507 A1 * 11/2009 Clemmens ..... B01L 3/502715 436/501
2011/0212002 A1 * 9/2011 Curry ..... B01L 3/5029 422/430
2012/0231488 A1 * 9/2012 Marshall ..... B01L 3/502715 435/29
2013/0343955 A1 * 12/2013 Doyle ..... B01L 3/5055 422/82.02
2014/0274739 A1 * 9/2014 Rinker ..... G01N 33/5023 506/2
2014/0295441 A1 10/2014 Egan
2015/0118688 A1 * 4/2015 Weidemaier ..... B03C 1/01 435/7.1
2015/0182156 A1 * 7/2015 Engbersen ..... G01N 33/491 435/7.94
2016/0167047 A1 6/2016 Weber et al.
2017/0087547 A1 * 3/2017 Laukkonen ..... A61B 5/150755

FOREIGN PATENT DOCUMENTS

EP 2982436 A1 2/2016
WO 0074853 A1 12/2000
WO 2005094681 A1 10/2005
WO 2016040642 A1 3/2016

* cited by examiner

SAMPLE CARRIER

The present application is a 371 of International application PCT/EP2016/060498, filed May 11, 2016, which claims priority of EP 151 73 174.2, filed Jun. 22, 2015, the priority of these applications is hereby claimed and these applications are incorporated herein by reference.

BACKGROUND OF THE INVENTION

The invention relates to a sample carrier with a region for receiving a sample that is to be analyzed, in particular a biological sample, the volume of the sample being between 1 and 100 μl, and with a region for handling the sample carrier. The invention further relates to an analysis device, in particular a flow cell, with such a sample carrier.

WO 2005/094681 A1 discloses a sample carrier for receiving a biological sample, with a capillary taking up a dosed quantity of the sample. The capillary is adjoined by a cylinder space in which a piston for ejecting the sample from the capillary is movable via an air cushion. While the sample is being taken up by the capillary, an opening channel ensures venting of the cylinder. With the displacement of the piston in the cylinder, this opening channel closes.

WO 00/74853 A1 describes a sample carrier which is combined with a closure element for a container. With the closure of the container by the closure element, a biological sample, for example, enters the container interior, where it is screened off from the external environment and comes into contact with a diluting liquid. The diluted sample is then to be removed from the container and delivered for analysis.

SUMMARY OF THE INVENTION

The present invention makes available a novel sample carrier of the type mentioned at the outset, which sample carrier is characterized by devices with which the sample carrier containing the sample is connected in a fluid-tight manner to the sample in an analysis device.

Advantageously, a sample that is to be analyzed is supplied to the analysis process by the sample carrier according to the invention directly by the shortest route. The sample, e.g. a body fluid such as blood, urine and saliva, a food sample or an environmental sample, in particular a water sample, is no longer introduced into a flow cell via an input port that is to be closed after the introduction; instead the introduction of the sample into the analysis process is completed with the fluid-tight placement of the sample carrier carrying the sample quantity, optionally already dosed. It is possible to dispense with sample dosing inside the flow cell.

In a particularly preferred embodiment of the invention, the sample placed together with the sample carrier in the analysis device adjoins a cavity in the analysis device involved in the analysis, in particular in a flow cell, and the sample carrier closes the cavity off from the outside in a fluid-tight manner. Advantageously, with the placement of the sample carrier, the flow cell for example is automatically closed by the sample carrier itself. It goes without saying that the cavity can also be filled with a material that takes up liquid, e.g. a nonwoven or a porous membrane.

The abovementioned cavity can be, for example, a transport channel or a chamber, in particular a mixing chamber.

In another preferred embodiment of the invention, the sample placed together with the sample carrier in the analysis device can be detached from the sample-receiving region by a stream of fluid. The fluid can be both a flushing liquid and also a gas, in particular compressed air.

The abovementioned stream of fluid can be generated, for example, by emptying of a reagent reservoir integrated in the analysis device or connected in a fluid-tight manner to the analysis device, wherein, for example, a deformation of the reservoir space of the reagent reservoir is effected by actuation.

In a further embodiment of the invention, the sample carrier itself can have devices with which the sample to be analyzed is transported away from the sample carrier, e.g. a flushing channel extending through the sample carrier and guiding a flushing liquid or a flushing gas.

In another particularly preferred embodiment of the invention, the sample carrier has devices for pre-processing of delivered sample material. The sample to be analyzed is formed from this in the course of the pre-processing.

The pre-processing devices preferably comprise means for dosing the sample material, reagent means and/or separating means, in particular for separation of blood plasma.

The sample carrier expediently covers in a fluid-tight manner an opening leading into the cavity; in particular it can be inserted into the opening and preferably closes the opening like a stopper.

In a particularly preferred embodiment of the invention, an interference fit for the sample carrier is formed by the opening, wherein the sample carrier in particular has a cone corresponding to a Luer lock.

The sample carrier closing the opening like a stopper can be rotatable in the opening while maintaining fluid-tight closure.

It goes without saying that the sample carrier is produced, preferably in one piece, as a plastic injection-molded part, optionally with several sample-receiving regions formed on one sample carrier.

Preferably, the receiving region itself has means for receiving the sample in a dosed quantity, for which purpose, in addition to geometric boundaries of the sample-receiving region, it is possible to consider primarily surface coatings and/or locally used plastic materials for controlling the wettability of the receiving region, in particular in such a way that the sample-receiving region is selectively wettable with sample material.

Preferably, the handling region permits manual handling of the sample carrier without touching the sample.

The handling region can be a handle which, after placement of the sample carrier in the analysis device, can be broken away from the rest of the sample carrier at a predetermined breaking point.

In a further embodiment of the invention, the sample carrier can have a closure device which prevents removal of the positioned sample carrier from the analysis device, e.g. a snap-fit fastener or the like.

In a further embodiment, the receiving region of the sample carrier comprises a dry reagent, if appropriate for a first reaction with the sample.

BRIEF DESCRIPTION OF THE DRAWING

The invention is explained in more detail below on the basis of illustrative embodiments and with reference to the attached drawings which relate to these illustrative embodiments and in which.

DETAILED DESCRIPTION OF THE INVENTION

Figure 1:
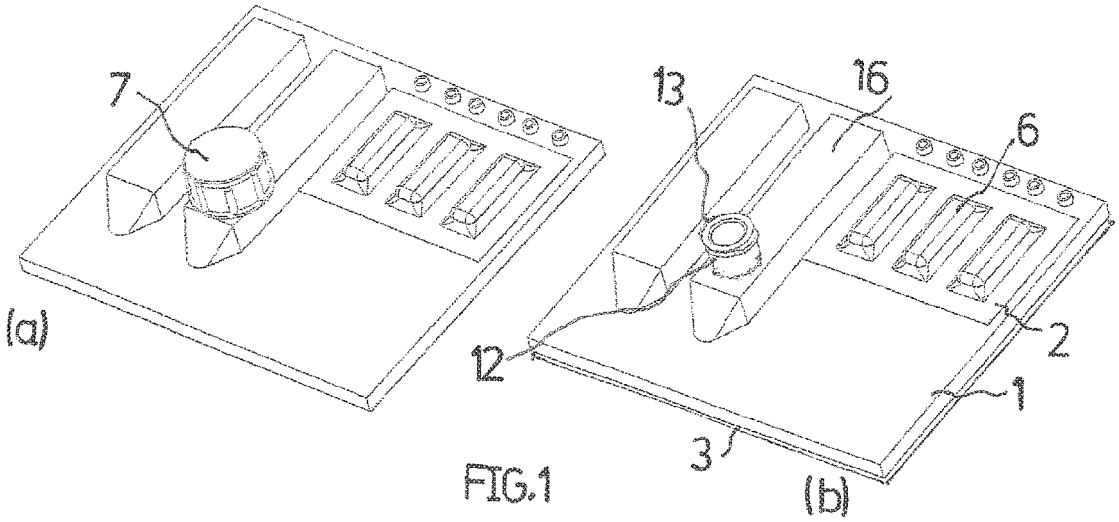
FIG. 1 shows a flow cell according to the invention in a perspective view, with and without a sample carrier.

A flow cell comprises an injection-molded plastic substrate 1, a laminate film 2 with layers of aluminum and plastic, and also a cover film 3 on the side of the substrate 1 facing away from the laminate film 2.

In the substrate 1, chambers and channels are formed, e.g. the chamber 4 and the channel 5. Bulges of the laminate film 2 form reservoir spaces 6.

As can be seen from FIG. 1*a*, a sample carrier 7 is arranged on a chamber wall 16 forming the chamber 4, which sample carrier 7 is screwed onto a stub 12 which protrudes from the chamber wall 16 and which has threaded projections 13.

Figure 2:
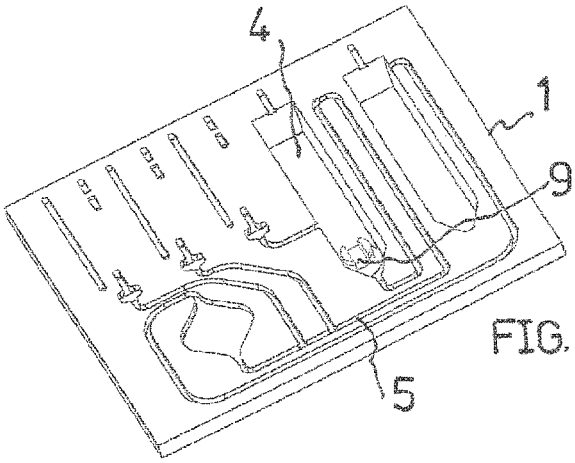
FIG. 2 shows the flow cell from FIG. 1 in a perspective view from below, with a sample carrier mounted on the flow cell.
Figure 3:
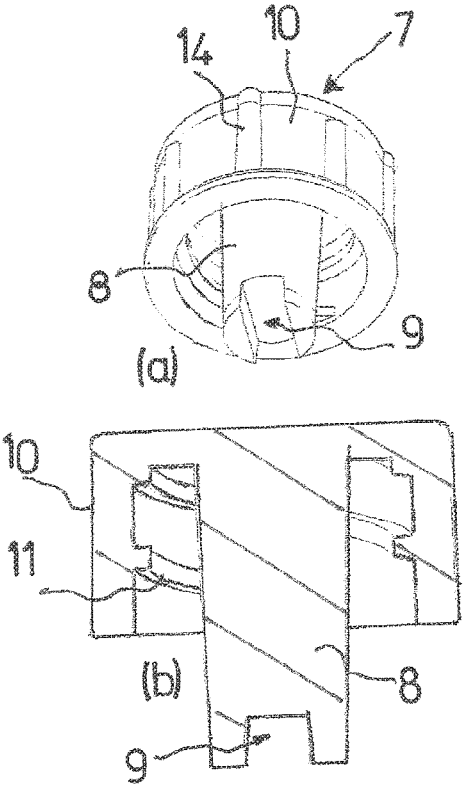
FIG. 3 shows the sample carrier used in the flow cell of FIGS. 1 and 2, in a perspective view and in axial section.

The sample carrier 7 comprises a conical support element having a sample-receiving region 9 at a free front end thereof. The support element 8 protrudes from the bottom of a pot-shaped rotary handle part 10 with an internal thread 11, into which the threaded projections 13 engage, and with rib projections 14. As can be seen from FIG. 2, the sample-receiving region 9 of the sample carrier 7 screwed onto the stub 12 projects into the chamber 4. In order to introduce a sample to be analyzed into the flow cell, sample material 15 is applied, according to FIG. 4, to the sample-receiving region 9. In the example shown, the sample-receiving region 9 comprises a groove 18 which is open on three sides and in which there remains a sample quantity held by capillary forces. The user, holding the sample carrier 7 at the rotary handle part 10, does not come into contact with the sample quantity when introducing the sample quantity into the flow cell by screwing the sample carrier 7 onto the stub 12. During said screwing, the conical support element 8 forms a fluid-tight interference fit with the conical inner surface of the stub 12.

Figure 4:
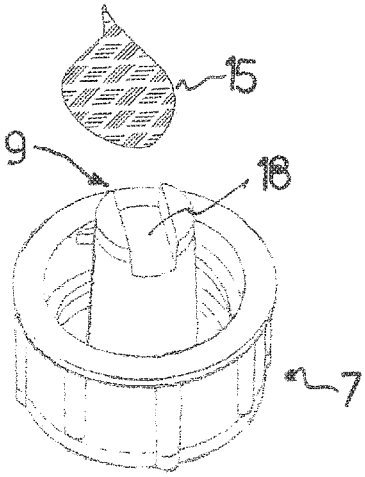
FIG. 4 and FIG. 4*a* are views illustrating how a sample is received by the sample carrier of FIGS. 1 to 3.
Figure 4A:
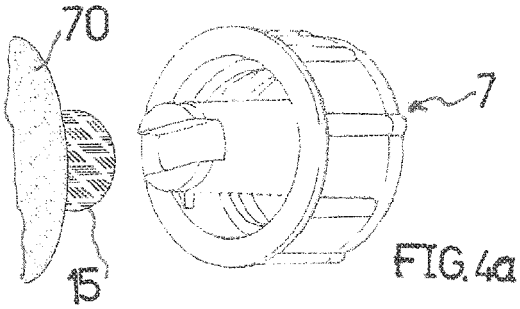

When supplying liquid sample material 15 to the receiving region 9 in accordance with FIG. 4, a defined sample quantity is measured out that remains in the groove 18 open on three sides. This is done, for example, by dipping the receiving region 9 into an openly accessible sample droplet, which can be located, for example, at the outlet of a syringe, in a container such as a microtiter plate, or, specifically in the case of blood as sample material, also on the skin of a patient, e.g. on a finger pad 70 in accordance with FIG. 4*a*. Alternatively, the sample material can also be pipetted on or dropped on. Critical factors in the measuring of a defined sample quantity are, on the one hand, the geometric shape of the groove 18, the walls of which form boundaries. In the example in question, the cross section of the groove is ca. $2\times2$ mm$^2$. Reproducible measurement of a sample quantity is permitted, on the other hand, by a coating that is provided in the receiving region 9 and determines the wettability of the groove walls. For example, blood or other aqueous samples as fluid sample material fill the groove by capillary action, in which case, on account of the hydrophilic wetting properties, a defined blood sample quantity is measured.

The blood sample quantity bound by capillary forces remains adhering in the receiving region 9 and is introduced into the chamber 4 with the aid of the sample carrier 7, as has been described above. In the course of an analysis that is to be carried out, the sample is flushed from the sample carrier.

A sample carrier corresponding to the sample carrier 7 is shown in FIG. 5*a*. The groove 18, open on three sides, receives a defined sample quantity 17.

FIGS. 5*b* to 5*g* illustrate further possibilities for the formation of receiving regions 9 of the above-described sample carrier 7.

FIG. 5*b* shows a receiving region in the form of a pocket-shaped recess 19 in the end face of the conical support element 8. A sample quantity 20 in droplet form is formed reproducibly through the recess 19.

FIG. 5*c*, like FIG. 5*b*, relates to a receiving region in the form of a circular recess. However, the preferably hydrophilized recess has a microstructure that enlarges the wetting surface, e.g. columns 21 protruding from the bottom of the recess. A network of the column arrangement measures between 10 and 500 μm, preferably between 20 and 200 μm. The microstructure leads to improved wetting properties and better control of droplet formation, hence further improved reproducibility of the sample quantities.

FIG. 5*d* shows a receiving region which is formed by a serpentine groove channel 22, open at its ends, in the end wall of the conical support element. In the example shown, the cross section of this channel measures 0.2×0.2 $mm^2$, preferably between 0.1 and 0.5 $mm^2$. The smaller cross-sectional dimensions of the optionally hydrophilically modified channel permit better control of the wettability and therefore of the reproducibility of the measured sample quantity.

An illustrative embodiment shown in FIG. 5*e* is identical to the example in FIG. 5*d* except for a cover film 23 which is arranged on the end face of the conical support element and which forms one part of the in this case two-part sample carrier. The groove channel 22 closed by the cover film 23 is filled by capillary action via an open end, as a result of which, in particular by partial or complete hydrophilic modification, a sample quantity can be measured very precisely since the capillary filling at the respective other end of the channel terminates by itself. In order to flush out the metered sample quantity, a flushing device with a targeted action is preferably used in the analysis appliance.

A further two-part sample carrier with a through-hole 24 as receiving region has a permeable membrane 25 closing the through-hole at one end. The membrane has pores of such a size that they are permeable to gas but not to liquid. The air permeability of the membrane 25 permits capillary filling of the through-hole 24.

An embodiment with the same function but without a permeable membrane 25 is likewise conceivable.

To empty this sample carrier in an analysis device, a pneumatic or hydraulic pressure is applied to the side covered by the membrane.

Another two-part sample carrier is shown in FIG. 5*g*. A sample-receiving region is formed by an absorbent nonwoven 26 applied to the end face of the conical support element. The nonwoven 26 takes up sample liquid by capillary action.

In an analysis device, the sample can be released by squeezing the nonwoven or it can be flushed out with the aid of a flushing liquid. The sample can also be supplied for the analysis process by being brought into contact with a lateral flow membrane, where it is sucked out of the nonwoven 26 of the sample carrier by the capillary action of lateral flow membrane. This process can be supported by a flushing liquid which is transported through the lateral flow membrane.

Figure 6:
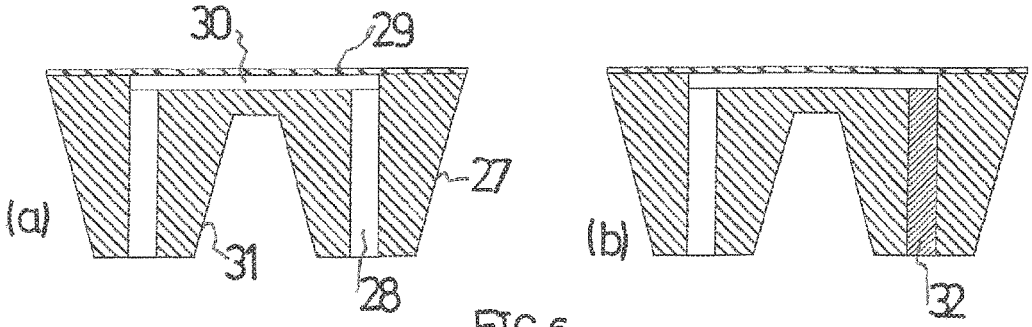
FIG. 6 shows a sample carrier according to the invention with a flushing channel and with a sample-receiving region formed by a capillary.

Reference is now made to FIG. 6, where a two-part sample carrier is shown which comprises a conical support element 27 having a through-hole 28. The through-hole 28, which can be filled with sample material by capillary action, terminates at a flushing channel 30 delimited by a film 29. The capillary filling of the through-hole 28 terminates automatically at the flushing channel 30. The flushing channel 30 leads through a further cone 31. By way of the conical support element 27 and the cone 31, the sample carrier can be connected to a flow cell, where a measured sample quantity 32 can be flushed hydraulically or pneumatically out of the through hole 28.

Figure 7:
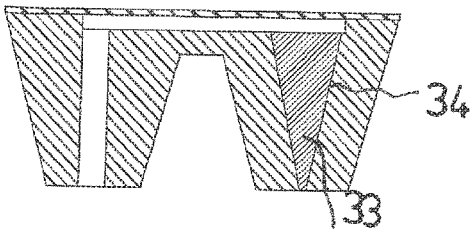
FIG. 7 shows a sample carrier according to the invention with a flushing channel and with a conical capillary receiving region.

FIG. 7 shows an illustrative embodiment which differs from the illustrative embodiment of FIG. 6 in that, instead of a through-hole 28 with an approximately constant cross section, a conically widening through-hole 34 is formed. In this way, a larger sample quantity 33 can be taken up in a smaller space. The smaller end opening of the through-hole 34 permits better reproducibility of the sample quantity that is taken up. Typical diameters at the narrowest point are between 0.1 and 0.3 mm. At the widest point, the diameter can be between 0.5 and 2 mm, while the length of the through-hole 34 is typically from 2 to 10 mm.

By varying the diameters or the volume of the sample-receiving region, different sample volumes can be introduced effectively into a microfluidic flow cell, and the measured quantities thus adapted to the requirements of different analyses and/or samples, simply by exchange of the sample carrier, with the external dimensions remaining the same.

Figure 8:
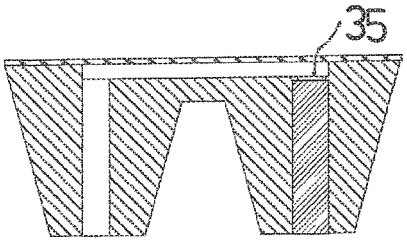
FIG. 8 shows a sample carrier according to FIG. 6 with an end constriction of the capillary.

A sample carrier shown in FIG. 8 is identical to the sample carrier from FIG. 6 except for a constriction 35 of its through-hole 28 at its end directed toward the flushing channel 30. The constriction 35 of the sample carrier in FIG. 8 forms a capillary stop that limits the capillary filling of the sample-receiving region with particular precision. The reproducibility of the measurement of samples is correspondingly high. In relation to the diameter of the through-hole 28, the dimensions of the constriction are typically reduced by 10 to 50%. The thickness of the lip forming the constriction is typically from 0.02 to 0.2 mm.

Figure 9:
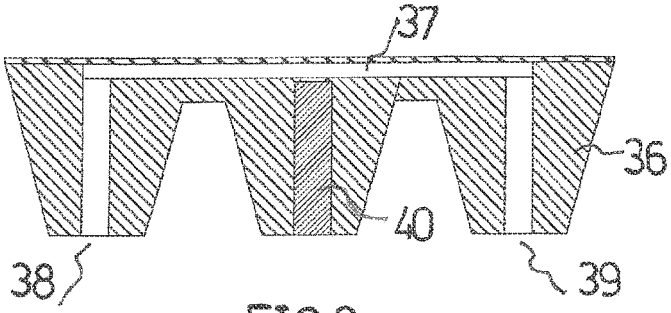
FIG. 9 and FIG. 9*a* show a sample carrier according to the invention, with a flushing channel opening out at each of the ends of a cone.

FIG. 9 concerns a sample carrier which, compared to the sample carrier in FIG. 8, is extended by a further cone 36 and has a flushing channel 37 with two inlets 38 and 39. In the sample carrier of FIG. 9, it is advantageously possible to prevent the formation of an air cushion upstream from the flushing liquid in the direction of flow, since the flushing liquid is first introduced from the inlet 38 to the inlet 39 and, in this way, all the air is removed from the flushing channel 37. The inlet for the sample is blocked by a valve (not shown). To flush out a sample quantity 40, the valve is opened, and a valve (not shown) at the inlet 39 is closed. The flushing liquid flowing through the inlet 38 now transports the sample quantity 40 from the sample-receiving region.

Figure 9A:
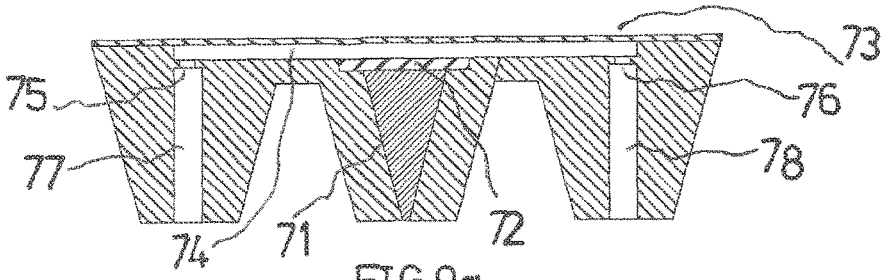

A sample carrier shown in FIG. 9*a*, and similar to the sample carrier of FIG. 9, has three conical plug elements, with which it can be plugged onto a flow cell. The central plug element forms a sample-receiving region with a widening receiving space 71 for receiving a blood sample. The receiving space 71, fillable by capillary action and having hydrophilically coated walls, is delimited, at its end facing away from an opening, by a plasma separation membrane 72, which limits the quantity of blood sample taken up.

The plasma separation membrane 72 adjoins a channel 74 which is coated hydrophilically on the inside and covered by a film 73, the ends of the channel 74 being connected, in each case via a constriction 75, 76, to a flushing channel 77, 78 which leads through an outer plug element. In the example shown, the volume of the receiving space 71 is about 2½ times as great as the volume of the channel 74.

In the state in which the sample carrier shown in FIG. 9*a* is plugged onto a flow cell, the central conical element terminates in a blind hole, such that the receiving space 71 is closed. Plasma of the blood sample received in the receiving space 71 passes through the plasma separation membrane 77 into the channel 74, which fills by capillary action, wherein the constrictions 75, 76 each form a capillary stop, such that a precisely measured quantity of plasma fills the channel 74. By way of the flushing channels 77, 78, this quantity of plasma can be flushed out by a flushing liquid or a flushing gas and supplied for processing inside the flow cell. In addition to having the function of receiving the sample, the sample carrier shown in FIG. 9*a* thus has the function of pre-processing the sample.

Figure 10:
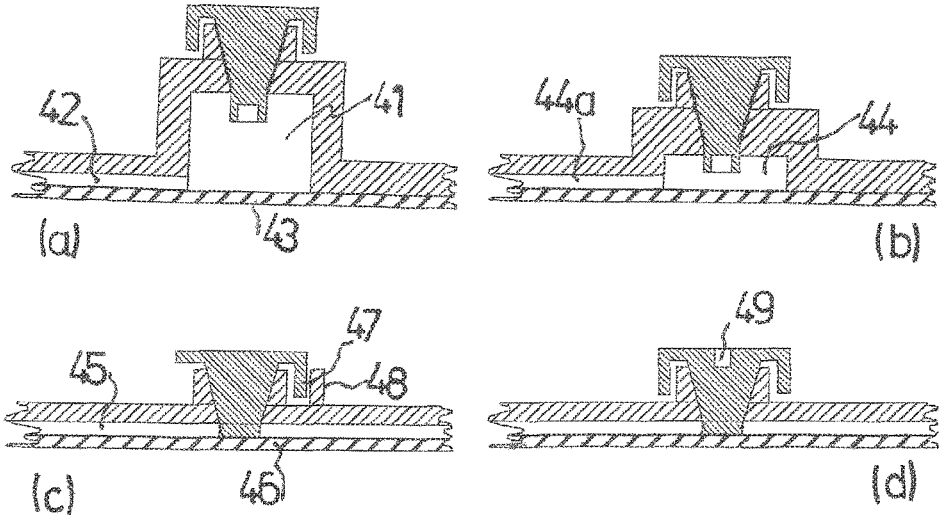
FIG. 10 shows examples for the connection of a sample carrier according to the invention to different regions of a flow cell.

FIG. 10 illustrates possible ways of connecting a sample carrier to different functional regions of a flow cell.

According to FIG. 10*a*, the receiving region of a sample carrier protrudes with a conical support element into a mixing chamber 41 of a flow cell, wherein it is connected to the chamber wall by a conical interference fit. The mixing chamber can be partially or completely filled with flushing liquid, e.g. from a reagent reservoir, via a channel 42, as a result of which the sample is released from the sample carrier and diluted. Here, the flow cell is preferably located in a vertical position, such that the level of the liquid in the mixing chamber can be monitored through a transparent cover film 43 and/or air located in the mixing chamber can escape during the mixing process. For the release of the sample, it is advantageous to agitate the flushing liquid, i.e. pump it back and forth. The diluted sample can be transported through the channel 42, or another channel connected to the mixing chamber, for further analysis or processing within the flow cell. The flow cell and the sample carrier can have structures, e.g. snap-fit fasteners, undercuts or latching lugs, which latch into place upon connection of the sample carrier to the flow cell and which prevent removal of the sample carrier after the connection to the flow cell.

A sample carrier corresponding to the sample carrier from FIG. 5*a* is connected, according to FIG. 10*b*, to a chamber 44 which is arranged near but outside a center of rotation of the flow cell. In the flow cell, the transport of fluid takes place partially or completely by centrifugation. For further analysis, the sample is also transported by centrifugal force almost completely into a channel 44*a* attached to the transport chamber 44. An undiluted liquid sample can be transported away in the manner described.

According to FIG. 10*c*, a sample-receiving region of a sample carrier protrudes with a conical support element into a transport channel 45 of a flow cell. The end of the conical sample carrier extends as far as a cover film 46 of the flow cell. In the example shown, the sample carrier and the flow cells have an alignment element 47 and 48, respectively, in order to ensure that a groove-shaped sample-receiving region is aligned with the transport channel 45. From the sample-receiving region, the sample can be transported pneumatically or hydraulically in the transport channel 45 of the flow cell to further processing devices.

In an illustrative embodiment shown in FIG. 10*d*, alignment structures, e.g. a slot 49 or the like, are provided to indicate that a sample carrier is aligned with a groove-shaped sample-receiving region transversely to the longitudinal direction of a transport channel. Despite an interference fit, a sample carrier is still rotatable and can be transferred from such a position to the position shown in FIG. 5*d* where, according to the example of FIG. 10*c*, the sample-receiving region can be emptied.

Figure 5:
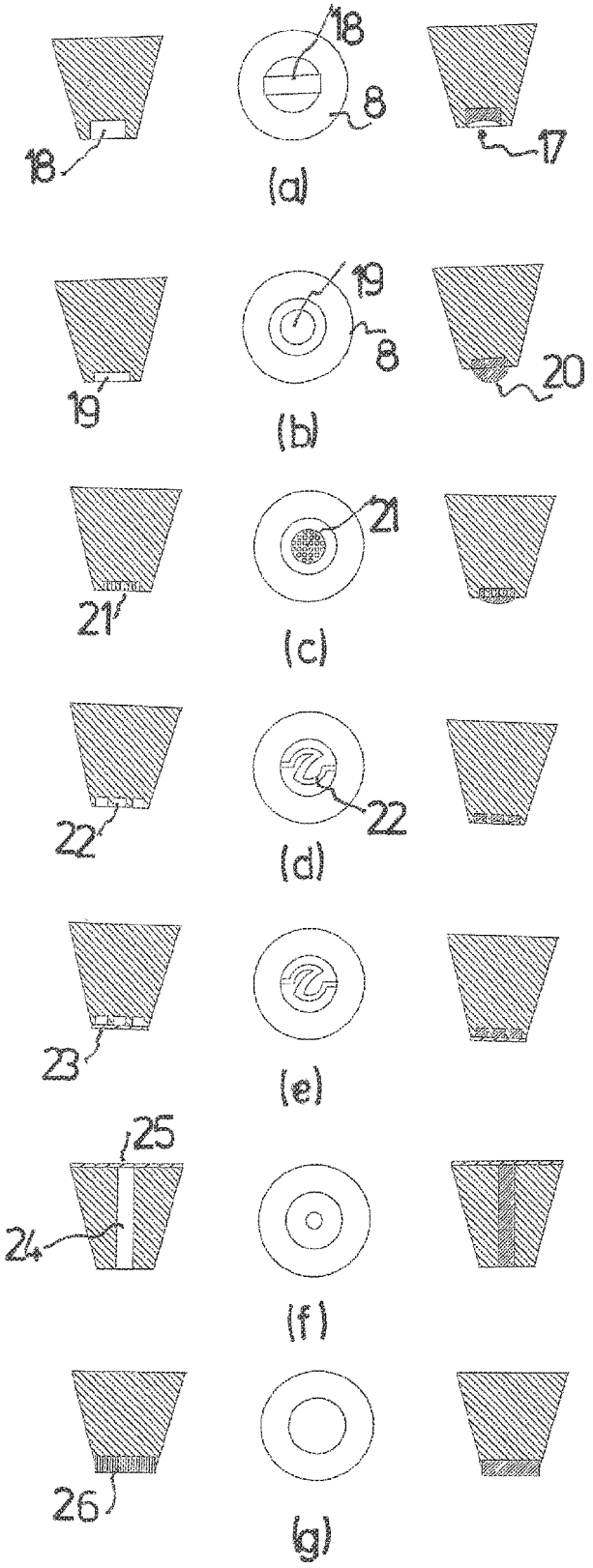
FIG. 5 shows different sample carriers according to the invention in sectional partial side views and in views from below.
Figure 11:
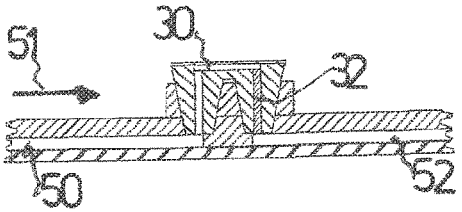
FIGS. 11 and 12 show the sample carriers from FIGS. 6 and 9 in conjunction with a flow cell.

FIG. 11 shows a connection of the sample carrier of FIG. 5 to a flow cell. The flushing channel 30 of the sample carrier is connected to a channel 50 of the flow cell, through which channel 50, according to arrow 51, compressed air or flushing liquid is supplied which forces the sample quantity 32 into a further channel 52 of the flow cell.

Figure 12:
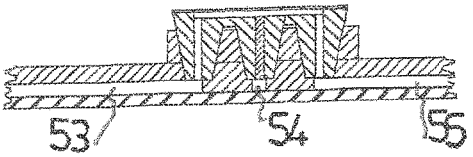

FIG. 12 shows an example for a connection of the sample carrier of FIG. 9 to a flow cell. By way of channels 53 to 55 of the flow cell, the stored sample quantity is flushed out in a manner that avoids an air cushion, as is described with reference to FIG. 9.

Plastics generally have hydrophobic surfaces that are difficult to wet with aqueous fluids such as blood. Hydrophilic surfaces are advantageous for the sample-receiving region of sample carriers, also with a view to an exact measurement of sample quantities.

Changes (hydrophilic or hydrophobic) to the surface properties of plastics occur, as is known from wet chemistry, by application of wetting agents or surfactants and subsequent drying, by surface activation by means of plasma, flame treatment or corona treatment (hydrophilic), by surface coating by means of plasma polymerization, e.g. formation of glass-like layers (hydrophilic or hydrophobic), or by combinations of these measures. If appropriate, local masking of treated surfaces takes place.

Figure 13:
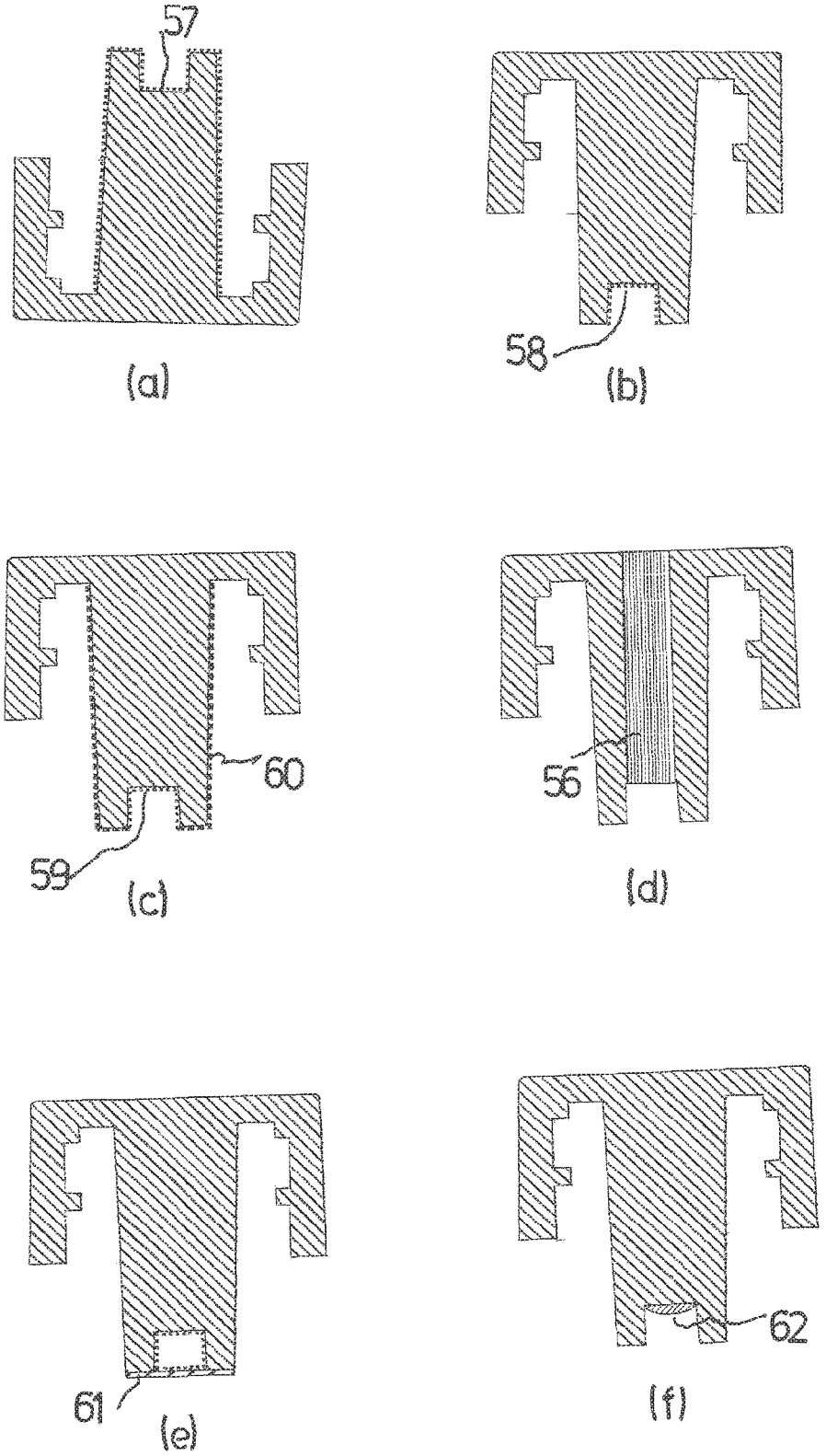
FIG. 13 shows different sample carriers according to the invention with different sample-receiving regions.

FIG. 13*a* shows a sample carrier whose sample-receiving region 57 and whose conical sealing region is hydrophilically coated, e.g. with a glass-like layer. The contact angle to water is <50°. When sample material is dropped on in a quantity that is greater than the sample quantity to be metered, the sample quantity to be metered, e.g. 10 $mm^3$, remains in the receiving region, while excess sample material, e.g. 30 to 40 $mm^3$, of a drop of blood runs down the conical support element and collects in the lower region of the sample carrier. By suitable retention structures, it is possible to prevent the collected sample material from entering a flow cell. In a departure from the example shown, the entire surface of the sample carrier could also be hydrophilized.

In the illustrative embodiment in FIG. 13*b*, a surface treatment is confined to a groove-like receiving region 58, which can be hydrophilically modified, for example by wet chemical treatment or masked plasma coating. In this illustrative embodiment, the sample is preferably taken up by dipping the sample carrier into a sample droplet, e.g. blood on a finger pad. The quantity of the sample taken up is defined by the geometry of the hydrophilically modified sample-receiving region. In the adjacent regions with a hydrophobic surface, the sample scarcely adheres or does not adhere at all.

The illustrative embodiment in FIG. 13*c* corresponds to the preceding illustrative embodiment but has in addition a hydrophobic coating 60 outside the sample-receiving region 59. The typical contact angle is >90°, in order to further increase the contrast in wettability between receiving region and adjoining region and thus more precisely measure out sample quantities.

FIG. 13*d* shows an illustrative embodiment for a sample carrier consisting of two differently wettable plastics. A core part 56 of a conical support element has a contact angle of <70°, e.g. PMMA, while an outer region of the conical support element, for example made of olefin plastic such as PP, has a contact angle of >90°. The geometry of the core part 56 is cylindrical. The combination of materials is chosen such that the two materials (e.g. PP and PMMA, PP and POM) are not connected rigidly but instead movably in the two-component injection molding procedure. By means of this "assembly-type injection molding", in which the inner core remains movable, it is possible to form a sample-receiving region that can be emptied by displacement of the inner core.

In the illustrative embodiment of FIG. 13*e*, compared to the illustrative embodiment of FIG. 13*b*, a groove-shaped sample-receiving region is formed which is closed on one side with a film 61, but is open at the ends. The inner walls of this channel-shaped receiving region can be coated hydrophilically, e.g. by wet chemistry or by means of plasma treatment.

In the illustrative embodiment of FIG. 13*f*, a sample-receiving region is partially or completely coated with a dry reagent 62 and functionalized. In this way, a sample can be conditioned immediately after being taken up by the sample carrier, before a connection of the sample carrier to a flow cell or other processing device takes place. For example, an anticoagulation reagent can be applied which, for example, prevents clotting of a quantity of blood on the sample carrier, for which purpose materials such as heparin or citrate may be considered. The dry reagent can also be a lysis buffer for lysis of cells, e.g. of a blood sample.

Figure 14:
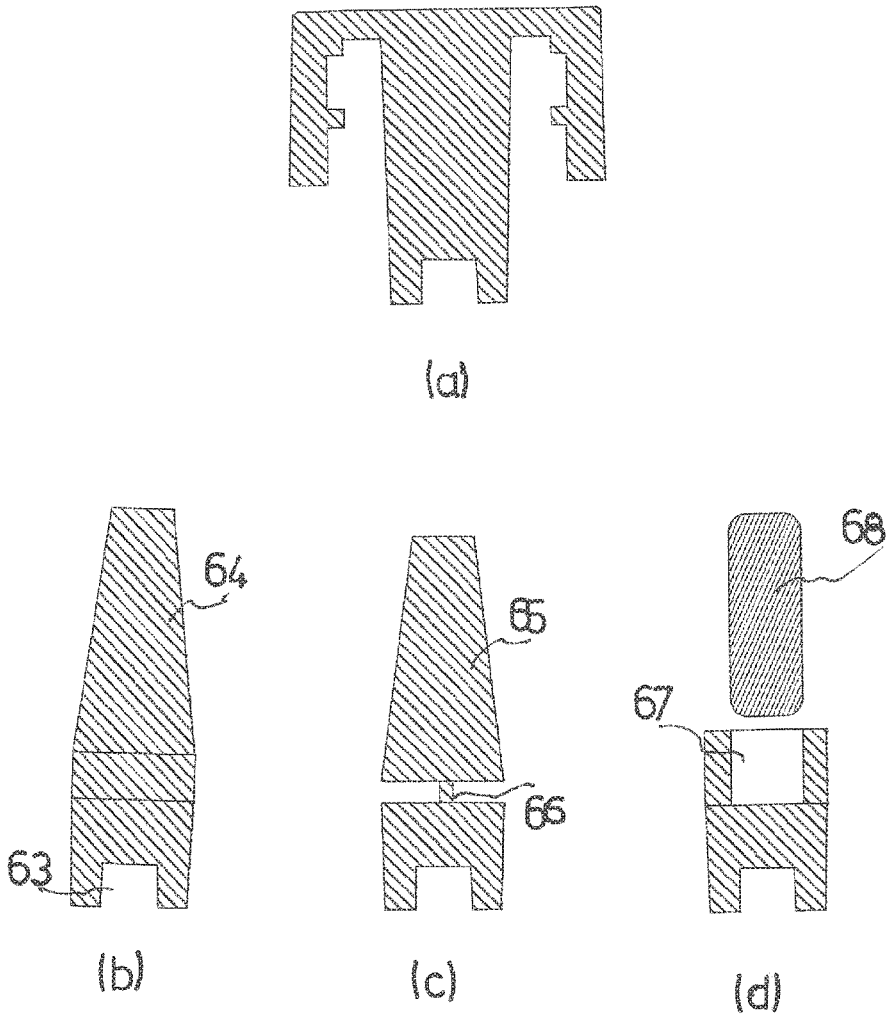
FIG. 14 shows sample carriers according to the invention with different handling regions.

While FIG. 14*a* again shows a sample carrier with, as in the preceding illustrative embodiments, a handling region surrounding the conical support element in a pot shape, the illustrative embodiment in FIG. 14*b* has a sample carrier with a conical handle 64 and a receiving region 63.

In the illustrative embodiment in FIG. 14*c*, a conical handle part 65 can be broken off at a predetermined breaking point 66 after connection of the sample carrier, e.g. to a flow cell.

FIG. 14*d* shows a sample carrier with an indentation 67, into which it is possible to insert a handling pin 68 which is releasable after connection of the sample carrier, e.g. to a flow cell.

Figure 15:
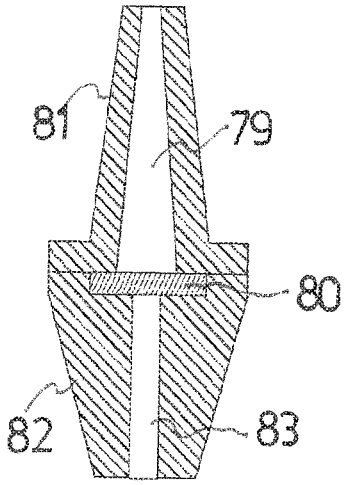
FIG. 15 shows a further sample carrier according to the invention for the pre-processing of a blood sample by separation of blood plasma.

A further sample carrier for pre-processing a blood sample is shown in FIG. 15.

In the sample carrier of FIG. 15, a conically widening sample-receiving space 79 is formed in a first plastic injection-molded part 81, said sample-receiving space 79 being delimited by a plasma separation membrane 80 which initially stops the capillary filling of the sample-receiving space 79 with a blood sample. A second conical injection-molded part 82, adhesively bonded or welded to the first injection-molded part 81, has a passage 83 that can be filled by capillary action. Both the sample-receiving space 79 and the passage 73 are provided with a hydrophilic coating on the inside. The sample carrier can be connected to a flow cell via the conical injection-molded part 82.

After a blood sample has been introduced into the receiving space 79, plasma passes through the plasma separation membrane 80 into the passage 83, the open end of the latter forming a capillary stop for metering the plasma sample.

When the sample carrier is plugged onto a flow cell, the first injection-molded part 81 can serve as a grip element, wherein a cap is expediently used if necessary in order to prevent contamination of the environment by blood that remains in the receiving space 79. The blood plasma to be analyzed by the flow cell can be sucked out of the passage with the aid of a nonwoven or of a membrane that adjoins the opening of the passage 83.

Figure 16:
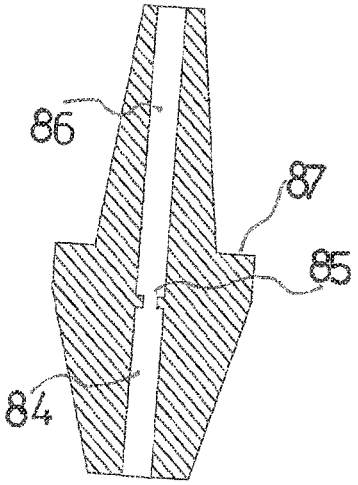
FIG. 16 shows a sample carrier according to the invention with a passage serving as a venting and flushing channel.

FIG. 16 shows a sample carrier produced in one piece as a plastic injection-molded part and having a passage 86 with a constriction 85. Except for the constriction 85, the passage 86 forms a sample-receiving capillary 84. The passage 86 extends through a conical element and through a grip part integrally connected to the conical element. An annular shoulder 87 is formed between the grip part and the conical element. When a sample is received in the sample-receiving capillary 84, the rest of the passage 86 forms a venting channel. When the sample carrier is connected to a flow cell, the passage 86 can moreover form a flushing channel for flushing the sample out into the flow cell.

Figure 17:
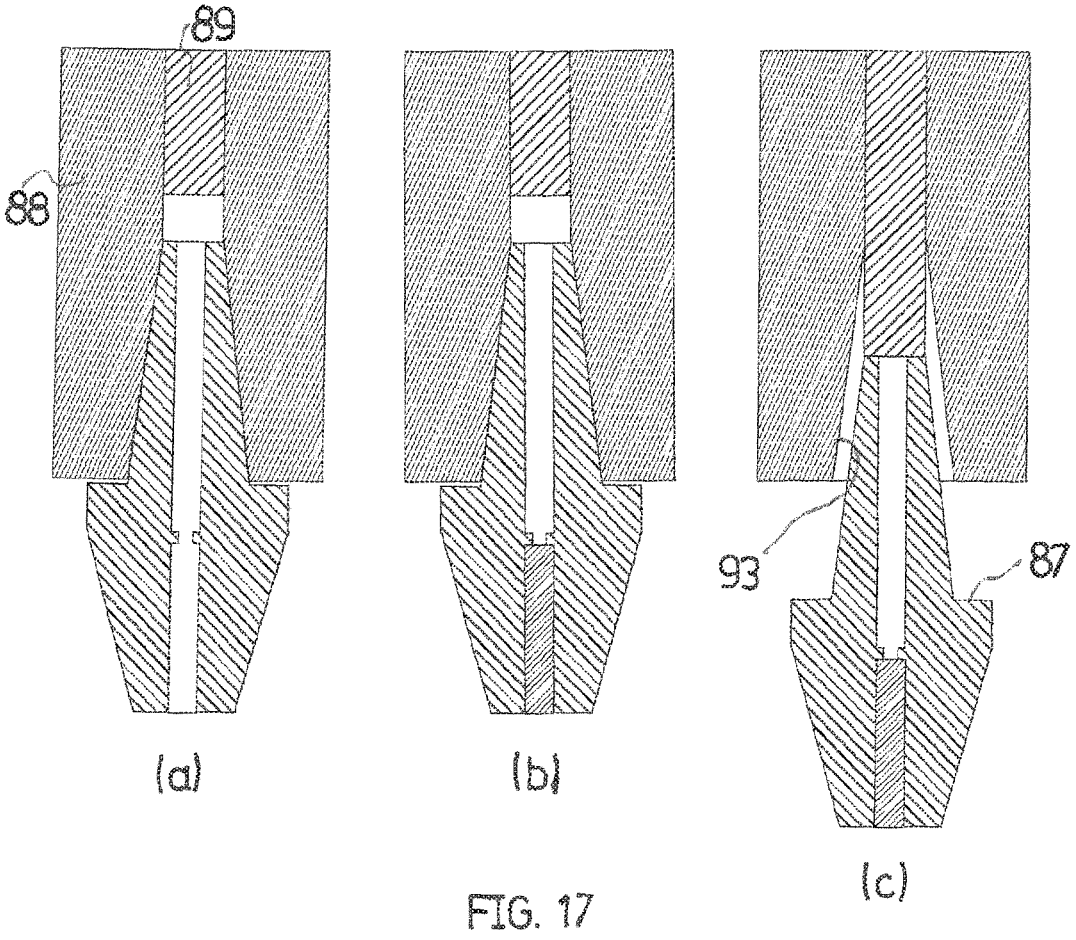
FIG. 17 shows the sample carrier from FIG. 16 in conjunction with a handling appliance.

FIG. 17 shows the sample carrier from FIG. 16 in conjunction with a pin-like handling appliance 88 which can be placed with one end onto the annular shoulder 87 and can be placed with a conical inner wall 93 onto a conical end of the sample carrier and can serve to plug the sample carrier onto a flow cell. In the manner of a ballpoint pen refill, the handling appliance has a core element 89 which is movable in the axial direction and whose movement according to FIG. 17*c* permits release of the handling appliance 88 from the sample carrier plugged onto the flow cell.

Figure 18:
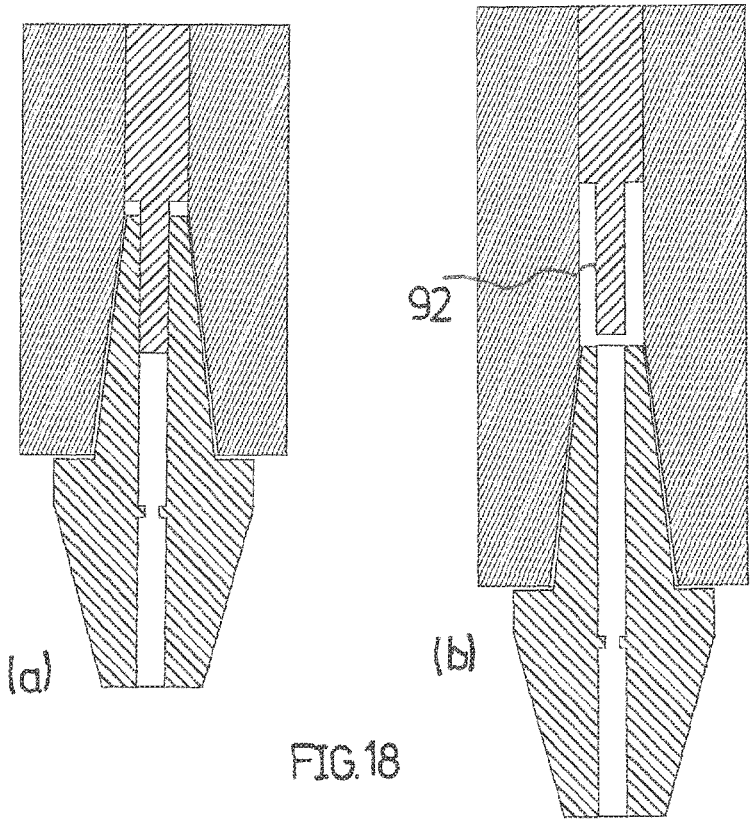
FIG. 18 shows the sample carrier from FIG. 16 in conjunction with a handling appliance modified in relation to the handling appliance from FIG. 17.

As can be seen from FIG. 18, the core element 89 can also have a clamping projection 92 for engagement in the passage 86 of the sample carrier. The clamping is provided in such a way that venting of the sample channel is not thereby disturbed. To release the clamping, the outer part of the handling appliance 88 is advanced, according to FIG. 18*b*, relative to the core element 89 under pressure against the annular shoulder 87.

Figure 19:
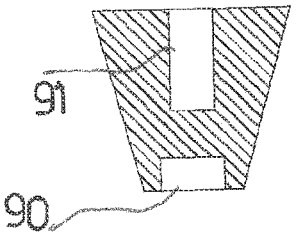
FIG. 19 shows a partial view of a further sample carrier according to the invention which can be manipulated by the handling appliance from FIG. 18.

FIG. 19 indicates that the sample carrier could also have a sample-receiving region 90 in the manner of a groove or recess, as is described above in connection, for example, with the sample carrier 7 from FIG. 4. The core element 89 of the handling appliance 88 could then engage with a clamping action in a longitudinal channel 91 of the sample carrier.

Figure 20:
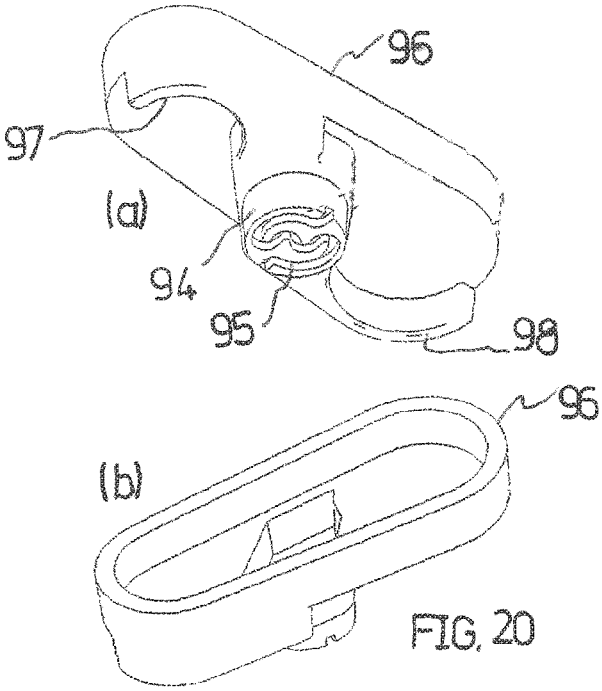
FIG. 20 shows a rotatable dosing element.
Figure 21:
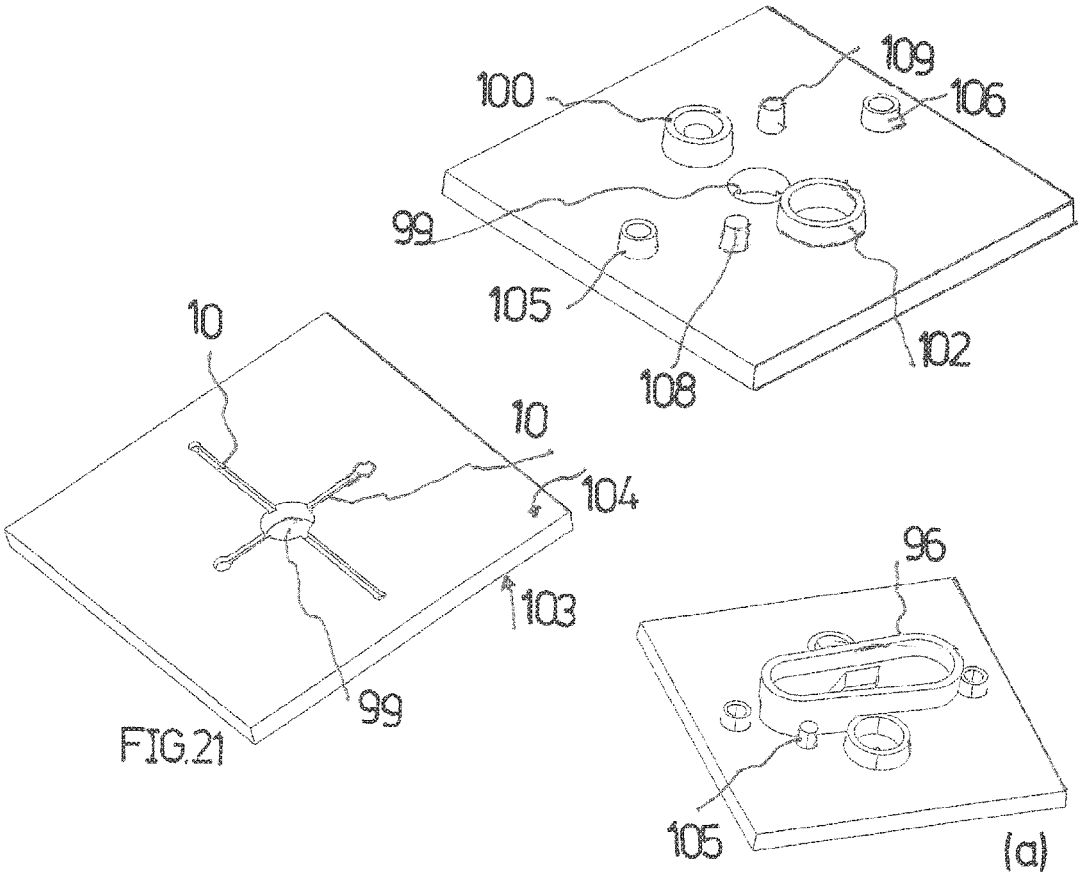
FIG. 21 shows a flow cell provided for cooperation with the dosing element from FIG. 20.

FIG. 20 shows a dosing element with a conical plug attachment 94, via which it can be plugged onto a flow cell shown in FIG. 21. The plug attachment 94 has a groove channel 95 in an end wall at the free end and is connected to a rotary handle 96 comprising two wings, each of them with an abutment 97, 98, respectively, on the wings.

The flow cell shown in FIG. 21 has a conical plug opening 99 for receiving the plug attachment 94. A sample can be introduced into the flow cell via an input port 100, e.g. with the aid of a pipette or syringe. The input port 100 is connected via a channel 101 and the plug opening 99 to an overflow port 102. The flow cell consists of a plate 103 and of a film 104 which is adhesively bonded or welded to the plate and which covers the channel 101.

The flow cell moreover has flush ports 105 and 106, which are connected to each other via a channel 107. Abutments 108 and 109 are formed on the plate 103, on the side directed away from the channels 101, 107.

In order to measure a sample, the dosing element is inserted, with the plug attachment 94 to the front, into the plug opening 99 of the flow cell, wherein the groove channel 95 is covered by the film 104. The dosing element is located in the rotation position shown in FIG. 22*a*, in which the wings of the rotary handle 96 bear against the abutments 108 and 109. In this position, according to FIG. 22*b*, the groove channel 95 of the conical plug attachment 94 supplements the channel 101 between the input port 100 and the overflow port 102. A sample material introduced into the input port 100 can flow across into the overflow port 102.

Figure 22:
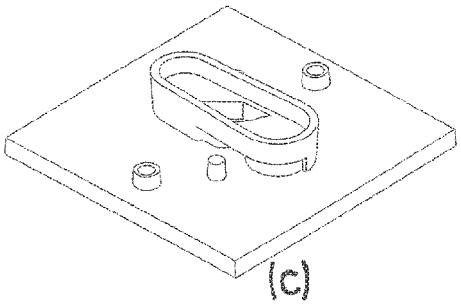
FIG. 22 shows an arrangement consisting of the dosing element from FIG. 20 and the flow cell from FIG. 21 in different working positions of the dosing element.
Figure 22:
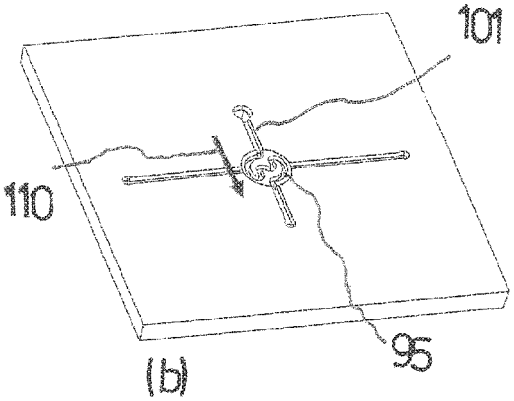
Figure 22:
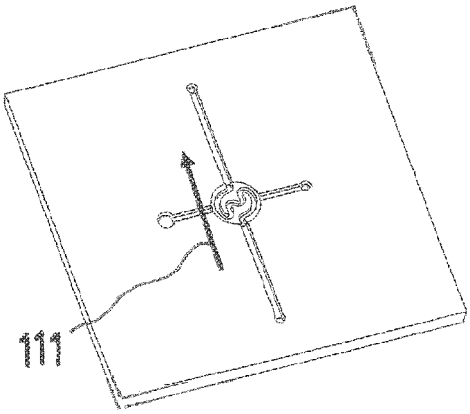

In order to dose a defined sample quantity, the dosing element is rotated through 90° and, according to FIG. 22*c*, bears with its abutments 97 and 98 against the input port 100 and overflow port 102, respectively (FIG. 22*c*). In this position, the openings of the ports are sealed by the wings of the rotary handle 96. By means of the rotation, a sample quantity is measured off which corresponds to the inner volume of the groove channel 95. In this position, the groove channel 95 supplements the channel 107 between the flushing ports 105, 106.

The dosed quantity of a sample contained in the groove channel 95 can therefore be flushed out of the flow cell via the flush ports 105 and 106 and delivered for further processing.

The invention claimed is:

1. A sample carrier assembly, comprising: a conical carrier body insertable into an opening of a flow cell to transport a sample to be analyzed into the flow cell; a receiving region for receiving the sample, the receiving region extending at a smaller end face of the conical carrier body, the conical carrier body being configured to meter a liquid sample having a volume between 1 and 100 μl and to adhere the sample to the conical carrier body; and, a handling region for handling the sample carrier assembly, the handling region extending at an end face of the conical carrier body opposite the smaller end face, wherein, when the carrier body is inserted into the opening, the conical carrier body fluid-tightly closes the opening with a lateral surface of the conical carrier body in manner of a stopper, wherein the conical carrier body is configured to be rotatable in the opening while maintaining fluid-tight closure of the opening, and the sample being washable from the receiving region for analysis by the flow cell.

2. The sample carrier assembly according to claim 1, wherein the sample carrier assembly is configured so that the sample to be analyzed, which is peaceable together with the sample carrier assembly in the flow cell, adjoins a cavity in the flow cell.

3. The sample carrier assembly according to claim 2, wherein the sample placed together with the sample carrier assembly in the flow cell is detachable from the receiving region by a stream of fluid, wherein the stream of fluid is generated, by emptying a reagent reservoir integrated in the flow cell.

4. The sample carrier assembly according to claim 1, further comprising pre-processing devices for pre-processing of sample material delivered to the sample carrier assembly for the sample to be analyzed, wherein the pre-processing devices comprise means for dosing, reagent means and/or separators.

5. The sample carrier assembly according to claim 1, further comprising a transport device with which the sample to be analyzed is transported away from the sample carrier assembly.

6. The sample carrier assembly according to claim 5, wherein the transport device is a flushing channel.

7. The sample carrier assembly according to claim 2, wherein the sample carrier assembly is configured to be placeable in a fluid-tight manner at an opening leading into the cavity.

8. The sample carrier assembly according to claim 7, wherein the sample carrier assembly is configured to close the opening like a stopper and an interference fit for a conical support element of the sample carrier assembly is formed by the opening.

9. The sample carrier assembly according to claim 4, wherein the receiving region comprises means for receiving the sample in doses.

10. The sample carrier assembly according to claim 9, wherein the means for receiving the sample in doses comprise spatial boundaries of the receiving region.

11. The sample carrier assembly according to claim 9, wherein the means for receiving the sample in doses comprise at least one surface coating for controlling wettability of the receiving region or differently wettable plastic materials adjoining the receiving region.

12. The sample carrier assembly according to claim 1, wherein the handling region is configured to permit manual handling of the sample carrier assembly without touching the sample.

13. The sample carrier assembly according to claim 8, wherein the sample carrier assembly closing the opening like a stopper is configured to be rotatable in the opening while maintaining fluid-tight closure of the opening.

14. The sample carrier assembly according to claim 2, further comprising a closure device that prevents removal of the sample carrier assembly connected to the flow cell.

15. The sample carrier assembly according to claim 4, wherein the receiving region comprises a dry reagent for a first reaction with the sample to pre-process the sample.

16. A combination comprising: an analysis device; and a sample carrier assembly according to claim 1.

* * * * *